US009549632B2

(12) United States Patent
Pickens

(10) Patent No.: US 9,549,632 B2
(45) Date of Patent: Jan. 24, 2017

(54) MAIL BOX SHIELD

(71) Applicant: Charles O Pickens, Farmington, CT (US)

(72) Inventor: Charles O Pickens, Farmington, CT (US)

( * ) Notice: Subject to any disclaimer, the term of this patent is extended or adjusted under 35 U.S.C. 154(b) by 0 days.

(21) Appl. No.: 14/941,644

(22) Filed: Nov. 15, 2015

(65) Prior Publication Data

US 2016/0073812 A1 Mar. 17, 2016

Related U.S. Application Data

(63) Continuation of application No. 13/747,845, filed on Jan. 23, 2013, now abandoned.

(51) Int. Cl.
*A47G 29/122* (2006.01)

(52) U.S. Cl.
CPC ..... *A47G 29/1216* (2013.01); *A47G 29/122* (2013.01)

(58) Field of Classification Search
CPC ..... A47G 29/122; A47G 29/1216; A47G 29/1209; E01F 13/02; E01F 7/02; E04H 1/1244
USPC 232/17, 38, 39; 40/606.06; 404/6; 256/12.5; 135/115
See application file for complete search history.

(56) References Cited

U.S. PATENT DOCUMENTS 3,709,237 A * 1/1973 Smith ..... E04H 1/1244 135/115
4,187,978 A * 2/1980 Dowker ..... A47G 29/1216 232/39
5,460,326 A * 10/1995 Albanesius ..... A47G 29/1216 232/17
D365,190 S * 12/1995 Albanesius ..... D99/43
6,824,113 B1 * 11/2004 Gee ..... A47G 29/1216 248/218.4
6,962,460 B1 * 11/2005 Pratt ..... G09F 7/00 248/636
7,080,773 B1 * 7/2006 Tepley ..... A47G 29/1216 232/17
D580,625 S * 11/2008 Ballok ..... D20/41
7,611,043 B2 * 11/2009 Black ..... A47G 29/1216 232/38
8,794,505 B1 * 8/2014 Richardson ..... A47G 29/1216 232/1 C
8,925,225 B2 * 1/2015 Fiore ..... A47G 29/122 232/39
2006/0186188 A1 * 8/2006 Belanger ..... A47G 29/1209 232/38
2008/0314967 A1 * 12/2008 Black ..... A47G 29/1216 232/39
2010/0243977 A1 * 9/2010 Middlebrook, Jr. ..... E01F 7/00 256/12.5

* cited by examiner

*Primary Examiner* — William Miller
(74) *Attorney, Agent, or Firm* — Robert S. Smith

(57) ABSTRACT

Apparatus for a protecting a roadside mail box from snow thrown by snowplow by which includes first and second generally planar members each having at least one rectilinear edge and a top and a bottom. Bracing members are fixed to the first and second generally planar members with the members forming a wedge shape with a vertical edge to divert the thrown by the snowplow.

3 Claims, 3 Drawing Sheets

MAIL BOX SHIELD

CROSS-REFERENCE TO RELATED APPLICATIONS

This application is a continuation of U.S. application Ser. No. 13/747,845 filed by Charles O. Pickens on Jan. 23, 2013.

TECHNICAL FIELD

The present invention is generally directed to apparatus to protect rural mailboxes that typically are located along the side of a road or highway. More particularly, the present invention is directed to protecting such mailboxes from the substantial impact of snow and ice often thrown at substantial speed by large powerful snow plows travelling at substantial speed. The damage to such mailboxes caused by snowplows and the inconvenience of the consequent mail service interruption is significant.

BACKGROUND OF THE INVENTION

Snow and snow plows are a fact of life during winter months in snow country of northern United States and Canada. Traditional roadside mail boxes and mail box posts offer little or no protection from snow and ice discharged by snow plows.

A wide variety of prior art mailbox protection apparatus is known. Some are improvised. Some are fragile and incapable of withstanding the huge mass of snow and ice being hurled at high speed by large fast moving snowplows. Devices erected to protect mail boxes and mail box posts are often home-made configurations of inferior materials and often survive for only short periods. Accordingly, it is therefore seen that there exists a need in the art to overcome the deficiencies and limitations described herein and above.

SUMMARY OF THE INVENTION

The shortcomings of the prior art are overcome and additional advantages are provided through apparatus for a protecting a roadside mail box from snow thrown by snowplow by which includes first and second generally planar members each having at least one rectilinear edge and a top and a bottom. The first and second generally planar members may be identical. Bracing members are fixed to the first and second generally planar members whereby the first and second generally planar members may be fixed to each other with each of the at least one rectilinear edges of each member disposed in parallel proximate relationship with an included angle between the first and second generally planar members of less than 180 degrees and defining a virtual edge or apex whereby the first and second generally planar members collectively define a wedge shape having a virtual edge or apex substantially coincident with both first and second planes extending through substantially all of the first and second generally planar members. The first and second generally planar members have openings disposed in respective parts of the first and second planar member for accommodating fasteners for engaging the ground with the virtual edge or apex substantially perpendicular to the ground.

In some embodiments the apparatus includes bracing members that include substantially identical first and second connector bars secured respectively to the tops of the first and second generally planar members and the bottom of the first and second generally planar members. The bracing members may include substantially identical first and second connector bars secured respectively to the tops of the first and second generally planar members and the bottom of the first and second generally planar members at points on the respective tops and bottoms that are distal to the virtual edge or apex of the apparatus.

Some embodiments of the apparatus further include substantially identical first and second connector plates engaging respectively the top and the bottom of the generally planar members proximate to the virtual edge.

The apparatus may further including at least one stake dimensioned and configured for passage through one of the openings disposed in respective parts of the first and second planar members.

The generally planar members may be rectangular and elongated intermediate the top and bottom thereof and may also include an opening proximate to the bottom thereof whereby access is provided for driving a stake and for snow to accumulated and stabilize the apparatus.

The generally planar members may be rectangular and elongated intermediate the top and bottom thereof and may also include an opening proximate to the bottom thereof whereby access is provided for driving a stake and for snow to accumulated and stabilize the apparatus.

In other embodiments of the present invention the first and second generally planar members, first and second connector bars, and the first and second connector bars are not identical.

Some embodiments of the apparatus include generally planar members that have an opening proximate to the bottom thereof whereby access is provided for driving a stake and for snow to accumulate and stabilize the apparatus.

Accordingly, it is an object of the present invention to provide apparatus that is durable despite the demanding environmental conditions It is another object of the present invention to provide apparatus that is capable of being manufactured economically and is therefore competitive economically.

It is yet another object of the present invention to reduce the cost of manufacture by providing, in some embodiments, pairs of identical elements in the apparatus and thus achieve economies of scale in the manufacture.

It is a still further object of the present invention to provide a structure that deflects the snow and ice being throw by snow plows and thereby minimizes the risk of the apparatus being damaged by oncoming snow and ice.

It is still another object of the present invention to provide apparatus that is easily setup in the fall and broken down in the spring . . . .

Lastly, but not limited hereto, it is an even further object of the present invention to provide aesthetically pleasing apparatus.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

The leading edge construction of the present apparatus advantageously deflects the impact of snow and ice being hurled by rushing snow plows. The illustrated embodiment of the present invention is simple to install and breakdown in the spring and thus avoids the difficulties inherent in of many improvised devices.

The illustrated embodiment of the invention include three pairs of identical interchangeable components. More particularly, they include two identical sides, two front connector plates, and two rear connector bars. Each of the two identical sides are generally planar and in one embodiment are positioned to form a wedge having leading substantially vertical edge facing substantially in the direction of the oncoming snow plow whereby the snow and ice being hurled by the snow plow is divided and diverted away from the mailbox.

In the illustrated embodiment first and second interchangeable sides are joined with first and second interchangeable front connector plates and first and second interchangeable rear connector bars with eight carriage bolts sets.

In one embodiment the assembled components are preferably positioned on level ground so that the top rear connector is approximately six inches in front of the mail box (on the side of the mailbox from which the snow plow approaches the mail box) and affixed to the ground with five stakes driven through the anchor holes.

The ninety degree leading edge construction faces the discharge snow emanating from oncoming snow plow and deflects the brunt of the snow plow discharge. (For convenience of description the term "snow" as used herein includes snow, water and ice.) The fully assembled view of the apparatus FIG. 1A illustrates its simplicity and manageability with all of its components and connectors affixed.

Figure 1B:
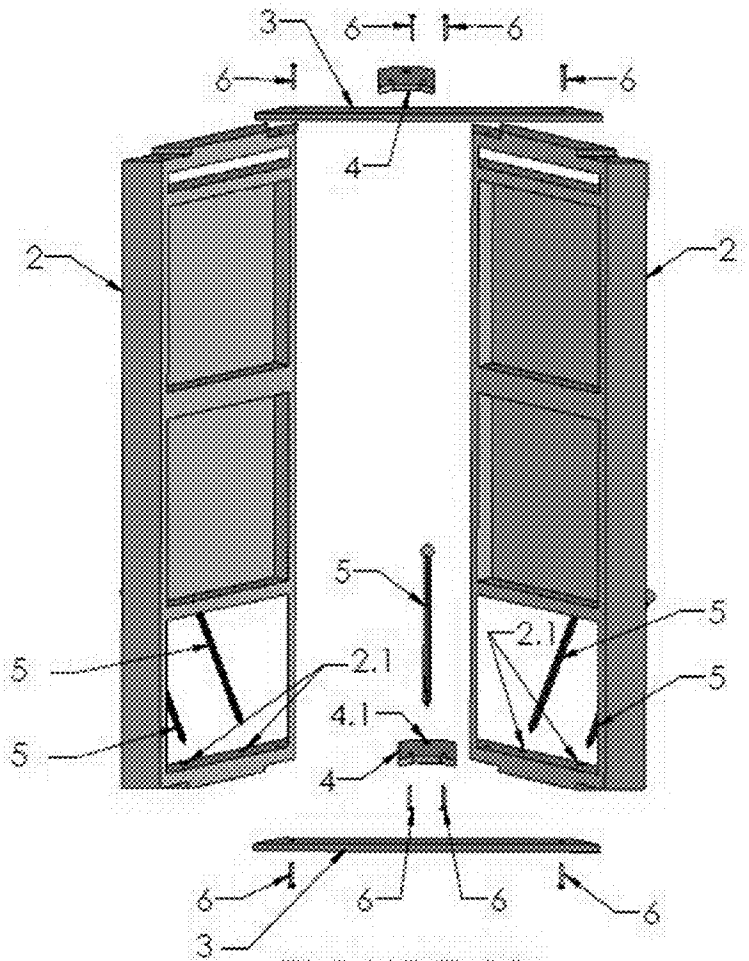
FIG. 1B is an exploded view of the apparatus shown in FIG. 1A.
Figure 1A:
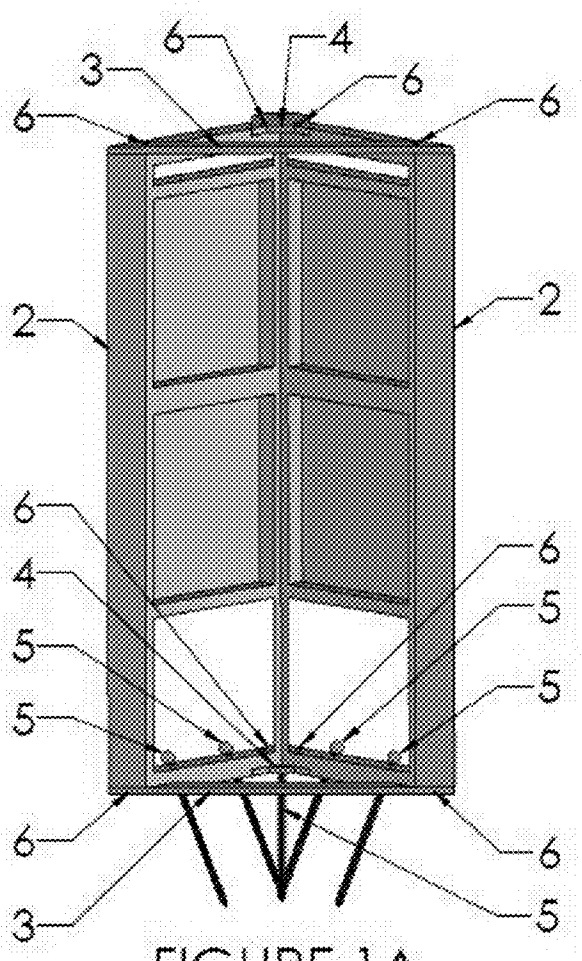
FIG. 1A is a rear view of one form of the assembled apparatus in accordance with the present invention.

One form of the present invention includes two identical interchangeable sides 2, shown in greater detail in FIGS. 1A and 1B in which the sides 2 are joined with an included angle of 90 degrees. Other embodiments may have a different included angle. The included angle is preferably less than 180 to achieve diversion of the snow being discharged by a snowplow. For convenience of description the line defined by the intersection of the planes defined by the converging generally planar sides 2 is referred to as a "virtual edge" herein. It will be understood that the arrangement of the converging sides is inherently a wedge shape the apex or virtual edge disposed to maximize deflection of the snow from an oncoming snow plow. It is preferable that the apparatus of the present invention be oriented so that a plane passing through the apex or virtual edge bisects the included angle between the sides 2 and extends generally toward the path of a snow plow advancing toward the apparatus.

Figure 3:
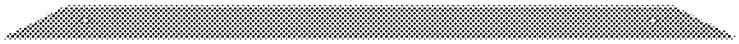
FIG. 3 is a side view of a rear connector bar which is part of the apparatus shown in FIG. 1A.

The interchangeable generally planar sides 2 are joined respectively at the top and bottom by one of two identical interchangeable connector bars 3 shown in greater detail in FIG. 3. As particularly shown in FIG. 1B the top and bottom surfaces of each interchangeable side 2 have respective oblique channels dimensioned and configured for engagement with the axial extremities of a connector bar 3. The connector bars 3 are secured in place by carriage bolt sets which are shown in greater detail in FIG. 6.

Figure 4:
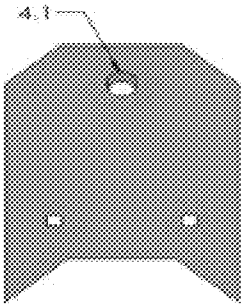
FIG. 4 is a side view of a front connector plate which is part of the apparatus shown in FIG. 1A.
Figure 6:
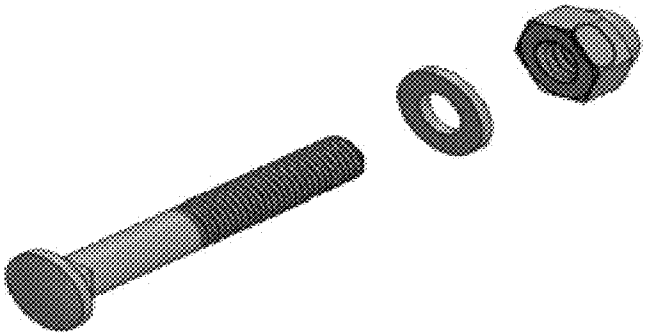
FIG. 6 is a side view of a carriage bolt, washer and nut which are parts of the apparatus shown in FIG. 1A.

The two identical interchangeable sides 2, are also joined respectively at the top and bottom proximate to the apex or virtual edge with one of two identical interchangeable connector plates 4 as best seen in FIG. 4. Two carriage bolt sets as shown in FIG. 6 are used to secure the connection. In the same manner that each side 2 has oblique channels to accommodate the connector bars 2 the sides 2 have recesses to accommodate the respective connector plates 4. The respective and recesses channels are visible in FIG. 1B. It is particularly surprising that the sides 2 are identical despite the presence of two channels on both the top and bottom of each side and despite the sides not being vertically symmetrical. More particularly, the opening at the bottom of the respective sides 2 prevents a user from inverting the top and bottom to facilitate engagement of the channels.

Figure 5:
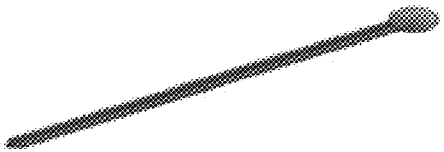
FIG. 5 is a side view of a stake which is part of the apparatus shown in FIG. 1A.

The apparatus is affixed to the ground at the bottom of the two identical interchangeable sides 2 with four stakes 5. More particularly the stakes 5, also shown in FIG. 5, are driven through the angled anchor holes 2.1 disposed in the lower extremities of sides 2. The sides have rectangular openings proximate to the anchor holes 2.1 to facilitate driving the stakes 5.

Figure 2:
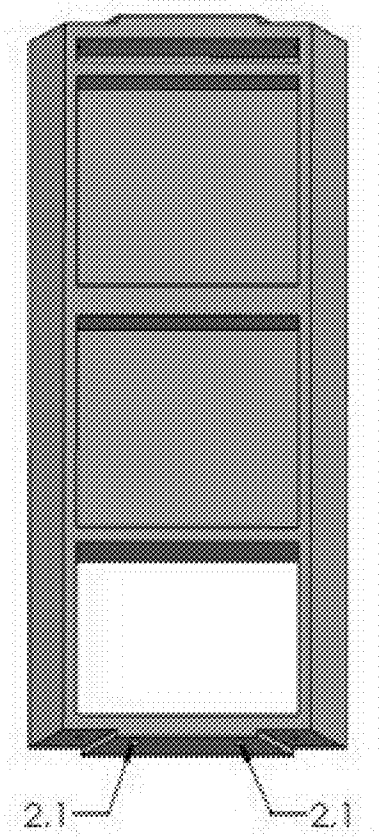
FIG. 2 is a side view of one of the generally planar sides of the apparatus shown in FIG. 1A.

FIG. 1B illustrates all of its components and connectors prior to assembly of one form of the present invention that includes two identical interchangeable sides 2, shown in greater detail in FIG. 2 are joined at the top with the identical interchangeable top rear connector bars, that are shown in greater detail in FIG. 3, with two carriage bolt sets, shown in greater detail in FIG. 6. Two identical interchangeable sides, shown in greater detail in FIG. 2, are joined at the bottom with the identical interchangeable bottom rear connector bars, shown in greater detail in FIG. 3, with two carriage bolt sets, shown in greater detail in FIG. 6. In FIG. 1B the two identical interchangeable sides 2, shown in greater detail in FIG. 2 are joined at the bottom with identical interchangeable bottom front connector plate illustrated in FIG. 4 with two carriage bolt sets shown in FIG. 6. The apparatus is affixed to the ground at the bottom of the two identical interchangeable sides 2 shown in FIG. 2 with four stakes 5 shown in FIG. 5 driven through angled anchor holes 2.1 in the sides 2.

As best seen in FIG. 1B the apparatus is also affixed to the ground with one stake 5 driven through the angled anchor hole 4.1 in the lower front plate 4. The sides 2 each have channels defined in the top and bottom surfaces that mesh with The Mail Box Shield apparatus is preferably installed with the virtual edge or apex facing the direction from which the snow plow will approach and in front of the roadside mail boxes to be protected from damage caused by the discharge of the snowplow. Protection is optimized with an angular leading edge sometimes referred to as an apex or virtual edge herein. Interchangeable components simplify assembly and achieve cost reductions due to economies of scale. Component compositions used in the sides 2 as well as other components insure long life. The lower extremity of the bottom of each side is provided with an opening to facilitate installation and maximize stability. More particularly, the sides utilize a sizeable open space at the bottom to allow the accumulation of snow and ice discharged by the snow plow to provide additionally stability after it freezes. In addition the opening facilitates hammering a stake to secure the apparatus to the ground.

In some embodiments all components and fixtures are designed to be easily constructed of non-metal composite materials. In addition, all components are durable and low temperature resistant.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A mail box protector apparatus for a roadside mail box which comprises:

first and second generally planar members each having at least one rectilinear edge and a top and a bottom, said first and second generally planar members being identical;

bracing members fixed to said first and second generally planar members whereby said first and second generally planar members are fixed to each other with each of the said at least one rectilinear edge of each member disposed in parallel proximate relationship with an included angle between said first and second generally planar members of less than 180 degrees and defining a virtual edge or apex coincident with both first and second planes that are coincident with both first and second planes extending through substantially all of said first and second generally planar members; and said first and second generally planar members have openings disposed in respective parts of said first and second planar members for accommodating respective fasteners for engaging the ground with said virtual edge or apex substantially perpendicular to the ground whereby said mail box protector apparatus is adapted to be anchored in front of said roadside mail box and further including substantially identical first and second connector plates engaging respectively said top and said bottom of said generally planar members proximate to said virtual edge.

2. A mail box protector apparatus for a roadside mail box which comprises:

first and second generally planar members each having at least one rectilinear edge and a top and a bottom;

bracing members fixed to said first and second generally planar members whereby said first and second generally planar members are fixed to each other with each of the said at least one rectilinear edge of each member disposed in parallel proximate relationship with an included angle between said first and second generally planar members of less than 180 degrees and defining a virtual edge or apex that is coincident with both first and second planes that are coincident with both first and second planes extending through substantially all of said first and second generally planar members; and said first and second generally planar members have openings disposed in respective parts of said first and second planar member for accommodating structure for engaging the ground with said virtual edge or apex substantially perpendicular to the ground whereby said mail box protector apparatus is adapted to be anchored in front of said roadside mail box and further including first and second connector plates engaging respectively said top and said bottom of said generally planar members proximate to said virtual edge.

3. A mail box protector apparatus for a roadside mail box which comprises:

first and second generally planar members each having at least one rectilinear edge and a top and a bottom, said first and second generally planar members being identical;

bracing members fixed to said first and second generally planar members whereby said first and second generally planar members are fixed to each other with each of the said at least one rectilinear edge of each member disposed in parallel proximate relationship with an included angle between said first and second generally planar members of less than 180 degrees and defining a virtual edge or apex that is also coincident with both first and second planes that are coincident with both first and second planes extending through substantially all of said first and second generally planar members; and said first and second generally planar members have openings disposed in respective parts of said first and second planar member for accommodating fasteners for engaging the ground with said virtual edge or apex substantially perpendicular to the ground and said bracing members include substantially identical first and second connector bars secured respectively to the top of said first and second generally planar members and the bottom of said first and second generally planar members whereby said mail box protector apparatus is adapted to be anchored in front of said roadside mail box and wherein said bracing members include said substantially identical first and second connector bars being secured respectively to the top of said first and second generally planar members and the bottom of said first and second generally planar members at points on the respective top and bottom are distal to the virtual edge or apex of the apparatus and further including substantially identical first and second connector plates engaging respectively said top and said bottom of said generally planar members proximate to said virtual edge.

* * * * *